US007731518B2

(12) United States Patent
Miyazoe

(10) Patent No.: US 7,731,518 B2
(45) Date of Patent: Jun. 8, 2010

(54) STACKING CONNECTOR

(75) Inventor: Shinji Miyazoe, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 12/434,776

(22) Filed: May 4, 2009

(65) Prior Publication Data

US 2009/0291596 A1 Nov. 26, 2009

(30) Foreign Application Priority Data

May 21, 2008 (JP) ..... 2008-133028

(51) Int. Cl.
*H01R 13/62* (2006.01)

(52) U.S. Cl. ..... 439/328; 439/631

(58) Field of Classification Search ..... 439/327, 439/637, 631, 328, 59
See application file for complete search history.

(56) References Cited

U.S. PATENT DOCUMENTS 4,717,218 A * 1/1988 Ratcliff ..... 439/59
5,037,309 A * 8/1991 Abe et al. ..... 439/56
5,240,420 A * 8/1993 Roberts ..... 439/62
7,118,087 B2 10/2006 Miyazoe et al.

FOREIGN PATENT DOCUMENTS

JP 2005-308124 11/2005

* cited by examiner

*Primary Examiner*—Phuong K Dinh
(74) *Attorney, Agent, or Firm*—Oblon, Spivak, McClelland, Maier & Neustadt, L.L.P.

(57) ABSTRACT

A stacking connector is formed by a connector main body and a plug substrate, the connector main body has a substrate sandwiching member including a sandwiching gap into which the plug substrate fits, and a projection projecting into the sandwiching gap, the plug substrate has a concavity with which the projection engages in both top and bottom surfaces, and, after inserting the plug substrate into the sandwiching gap of the substrate sandwiching member, by sliding the plug substrate in a direction at right angles to the insertion direction, the concavity engages with the projection and the plug substrate is linked to the connector main body in an unremovable state.

4 Claims, 3 Drawing Sheets

STACKING CONNECTOR

TECHNICAL FIELD

The present invention relates to a stacking connector which is attached to each electromagnetic valve when a plurality of electromagnetic valves are connected to constitute an electromagnetic valve assembly, the stacking connectors being connected to each other by a plug-in mechanism to be used for transmitting and receiving electric signals.

BACKGROUND ART

For example, Japanese Unexamined Patent Application Publication No. 2005-308124 discloses a technology for constituting an electromagnetic valve assembly by connecting a plurality of electromagnetic valves. In such an electromagnetic valve assembly, a stacking connector is attached to each electromagnetic valve, and stacking connectors of adjacent electromagnetic valves are connected to each other by a plug-in mechanism, so that electric signals such as serial signals, parallel signals, and electric power signals are transmitted and received between each of the electromagnetic valves.

As shown in FIG. 9, a publicly known stacking connector used for this kind of electromagnetic valve comprises a connector main body 1 including an insertion slot 3 and a plurality of socket terminals 4 for an electric connection, and a plug substrate 2 including a plurality of plug terminals 5 on both top and bottom surfaces thereof. An attachment side part 2*a* of the plug substrate 2 is inserted between ends of the socket terminals 4, and socket terminals 4 and plug terminals 5 corresponding to each other are bonded by solder 6, so that the connector main body 1 and the plug substrate 2 are connected to each other. Furthermore, an insertion side member 2*b* of the plug substrate 2 is inserted into an insertion slot of another stacking connector, so that the two stacking connectors are electrically connected to each other.

However, in the conventional stacking connector, when connecting the connector main body 1 and the plug substrate 2, the socket terminals 4 and the plug terminals 5 are bonded by the solder, and the solder 6 is used to secure the electric connection between both the terminals 4 and 5 and also to secure a mechanical bonding strength between the connector main body 1 and the plug substrate 2. Because of this, when the number of terminals is large, the soldering operation is cumbersome. Furthermore, when a detaching force is applied between the connector main body 1 and the plug substrate 2, and the force is directly applied to the socket terminals 4 and plug terminals 5, it is easy to cause solder flaking and damaged terminals.

DISCLOSURE OF INVENTION

The object of the present invention is to provide a stacking connector for which socket terminals of the connector main body and plug terminals of the plug substrate do not need to be soldered to each other when connecting the connector main body and the plug substrate, therefore does not require soldering work, and furthermore, has a rational design structure with a large bonding strength.

To achieve the object, the stacking connector of the present invention is formed by the connector main body and the plug substrate. The connector main body comprises a substrate insertion slot which is open to the front, a substrate attaching member formed at a rear side, and a plurality of socket terminals extending from the substrate insertion slot to the substrate attaching member. In addition, the substrate attaching member comprises a substrate sandwiching member having a sandwiching gap into which the plug substrate fits, and projections projecting from the substrate sandwiching member into the sandwiching gap.

In addition, the plug substrate comprises a plurality of plug terminals, and is attachable to and detachable from the substrate attaching member, the plug substrate being constituted to be electrically connected to the socket terminals by being attached to the substrate attaching member. The plug substrate also comprises an attachment side part inserted into the sandwiching gap of the substrate sandwiching member, an insertion side member inserted into a substrate insertion slot of another stacking connector by extending from the connector main body, and concavities located in both top and bottom surfaces of the plug substrate. Furthermore, after inserting the attachment side part into the sandwiching gap of the substrate sandwiching member, by sliding the plug substrate in a direction at right angles to the insertion direction, the concavities engage with the projections and the plug substrate is linked to the connector main body in an unremovable state.

In the present invention, the connector main body has a pillar-shaped guide formed in the substrate sandwiching member, and the plug substrate has an L-shaped notch into which the pillar-shaped guide fits in the attachment side part. This notch includes a vertical hole part that is elongated in a front-back direction of the plug substrate and a horizontal hole part that is elongated in a left-right direction of the plug substrate. It is preferred that the stacking connector of the present invention is constituted so that, after inserting the attachment side part of the plug substrate into the sandwiching gap in a condition in which the pillar-shaped guide is fitted into the vertical hole part, when sliding the plug substrate in a direction at right angles to the insertion direction to engage the projection with the concavity, the pillar-shaped guide fits into and engages with the horizontal hole of the notch.

In the present invention, it is preferred that the substrate sandwiching member comprising a top-bottom pair of sandwiching arms facing each other is formed at both left and right edges of the connector main body respectively, the projection and the pillar-shaped guide are formed in each sandwiching arm, and the concavity and the notch are formed at both left and right sides of the plug substrate in locations corresponding to the sandwiching arms.

Since the stacking connector of the present invention is constituted so that the projections are provided in the substrate sandwiching member of the connector main body, and the concavities are provided in both top and bottom surfaces of the plug substrate, and furthermore, after inserting the plug substrate into the sandwiching gap of the substrate sandwiching member, by sliding the plug substrate in a direction at right angles to the insertion direction, the concavities engage with the projections and the plug substrate is connected to the connector main body in an unremovable state, it is not necessary to solder the socket terminals of the connector main body and the plug terminals of the plug substrate to each other when connecting the connector main body and the plug substrate, therefore the stacking connector does not require soldering work, and has an advantage that the connecting strength is high.

BEST MODE FOR CARRYING OUT THE INVENTION

Figure 1:
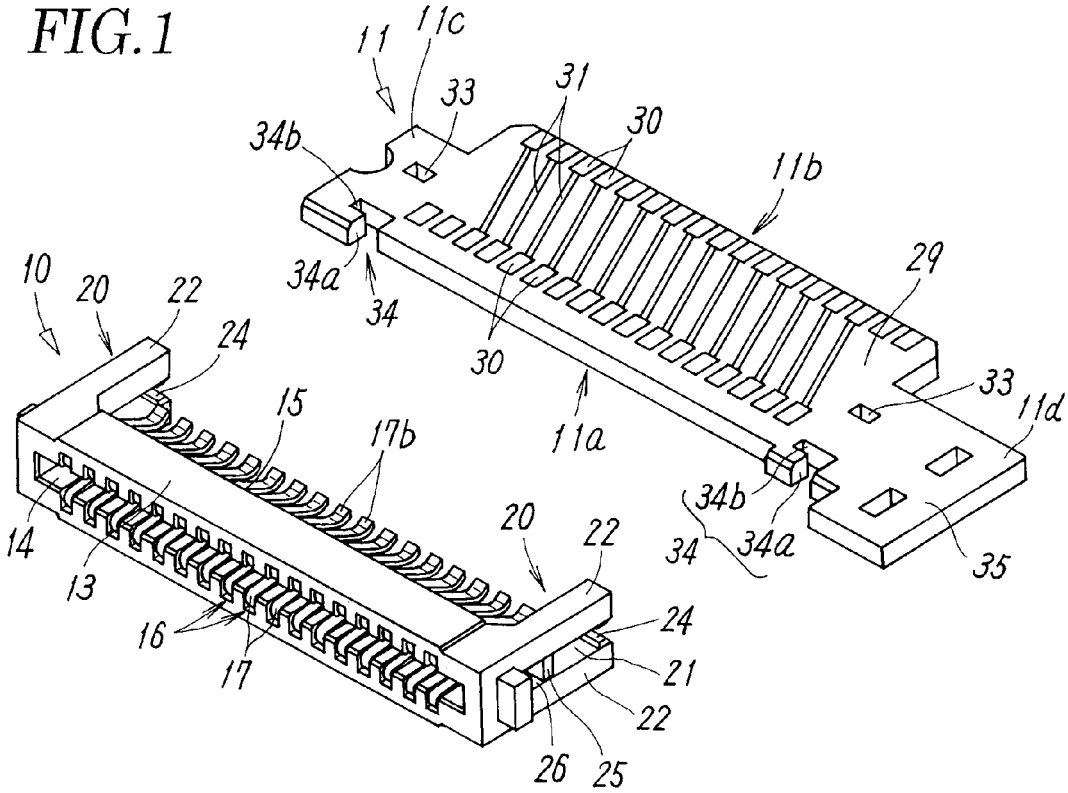
FIG. 1 is a perspective view showing an embodiment of a stacking connector of the present invention, the perspective view showing a condition in which a connector main body and a plug substrate are separated from each other.

FIGS. 1 to 8 show an embodiment of the stacking connector of the present invention. The stacking connector is formed by attachably and detachably attaching a plug substrate 11 which works as a plug to a connector main body 10 which works as a socket.

The connector main body 10 has a body 13 that is elongated in a lateral direction (left-right direction) and formed of an electrical insulating material such as a synthetic resin. A substrate insertion slot 14 is provided so as to be an elongated opening extending in the left-right direction of the body 13 in one side that is a front side in a front-back direction of the body 13, and a substrate attaching member 15 for attaching the plug substrate 11 is formed in the opposite side that is a rear side of the body 13, and furthermore, a plurality of socket terminals 16 are provided so that the socket terminals 15 extend from the substrate insertion slot 14 to the substrate attaching member 15 in the front-back direction of the body 13.

Figure 3:
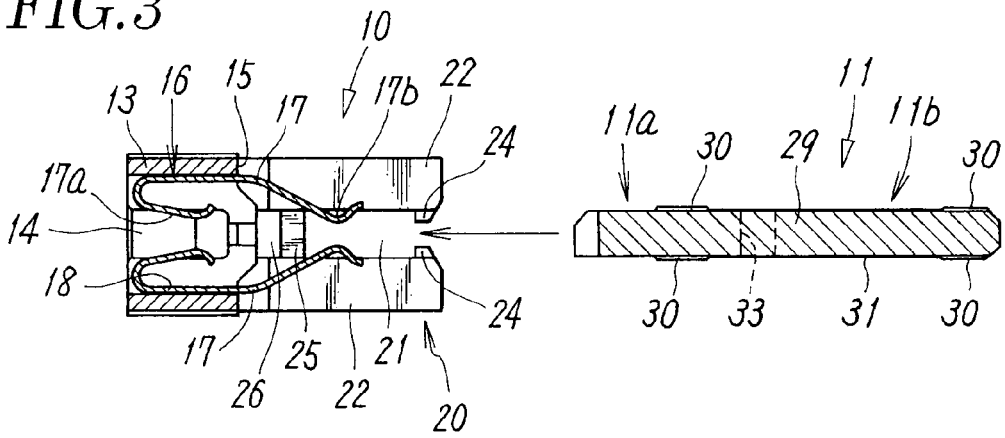
FIG. 3 is an enlarged cross-sectional view of FIG. 2.

As is obvious from FIG. 3, the socket terminal 16 is made of a pair of elastic metal members 17 facing each other. A front end member 17*a* of these elastic metal members 17 is bent to an approximate U-shape toward the inside of the substrate insertion slot 14 that is a side of the other elastic metal member 17, and the opposite side rear end member 17*b* is bent to an approximate V-shape toward the inside like the front end member 17*a*. In these elastic metal members 17, the front end members 17*a* are located in the substrate insertion slot 14 in a non-protruding state, and the rear end members 17*b* are accommodated in terminal accommodating grooves 18 formed in the body 13 in a state in which the rear end members 17*b* protrude from the body 13 to the substrate attaching member 15, so that the elastic metal members 17 are aligned in parallel with each other.

Substrate sandwiching members 20 are formed at both left and right edges of the connector main body 10, and sandwiching gaps 21 into which a part of the plug substrate 11 fits are formed in the substrate sandwiching members 20. The substrate sandwiching member 20 comprises a top-bottom pair of sandwiching arms 22 facing each other via the sandwiching gaps 21, and the sandwiching arms 22 extend from both left and right edges of the body 13 to backward of the body 13. Therefore, a rear part of the body 13 which is sandwiched by two of the left and right substrate sandwiching members 20 forms a concave shape, and the rear end members 17*b* of the elastic metal members 17 of the socket terminals 16 protrude into an area forming the concave shape.

Projections 24 are formed on inside surfaces facing each other in extending-direction ends (rear ends) or their vicinities of the top-bottom pair of sandwiching arms 22 so that the projections 24 project into the sandwiching gap 21, and a pillar-shaped guide 25 whose both top and bottom ends connect to both the sandwiching arms 22 is formed at a location moved a little in the extending direction from base ends of the both sandwiching arms 22, the base ends of which connect to the body 13. As a result, a space 26 is formed between the pillar-shaped guide 25 and the body 13.

On the other hand, the plug substrate 11 is constituted by providing plug terminals 30, the number of which is the same as that of the socket terminals 16 of the connector main body 10, on the substrate main body 29 which has a left-right elongated plate shape formed by an electrical insulating material such as a synthetic resin. More specifically, a half part of the plug substrate 11 in the front-back direction is an attachment side part 11*a* which fits between the sandwiching arms 22 of the connector main body 10 and also fits between the rear end members 17*b* of the socket terminals 16, and the other half part is an insertion side member 11*b* which is inserted into a substrate insertion slot of another similar stacking connector. The plug terminals 30 having flat surfaces are provided on both top and bottom surfaces of these attachment side part 11*a* and insertion side member 11*b*. Furthermore, the plug terminals 30 located on the attachment side part 11*a* and the plug terminals 30 located on the insertion side member 11*b* are connected to each other by printed wiring 31 formed on the plug substrate 11. The printed wiring 31 does not necessarily connect the plug terminals 30 to each other in a form as shown in figures.

At locations near both left and right edges of the plug substrate 11, a rectangular engaging hole 33 passing through the plug substrate 11 in the top-bottom direction is formed at locations outside of the plug terminals 30, and the engaging hole 33 forms a concavity with which the projection 24 formed in the sandwiching arms 22 of the connector main body 10 engages in both top and bottom surfaces of the plug substrate 11. Therefore, a length between the two left and right engaging holes 33 is the same as that between the projections 24 formed in the two left and right pairs of sandwiching arms 22. Since the engaging holes 33 and the concavities are practically the same things, the concavities are given the same reference numeral 33 as the engaging holes in the description below.

In addition, in the attachment side part 11*a* in the front part of the plug substrate 11, an L-shaped notch 34 into which the pillar-shaped guide 25 fits is provided at locations near both left and right edges of the plug substrate 11. The notch 34 comprises a vertical hole part 34*a* extending from the front edge of the plug substrate 11 toward the rear part of the plug substrate 11, and a horizontal hole part 34*b* extending laterally from a back end of the vertical hole 34*a* toward a first edge 11*c* that is the left edge of the plug substrate 11. The horizontal hole part 34*b* and the engaging hole 33 occupy mutually corresponding locations in the front-back direction of the plug substrate 11, and the vertical hole part 34*a* occupies a location shifted a little from the horizontal hole part 34*b* and the engaging hole 33 toward a second edge 11*d* that is the right edge of the plug substrate 11.

A reference numeral 35 in the figures indicates a handle member formed at one edge in the left-right direction of the plug substrate 11.

Figure 2:
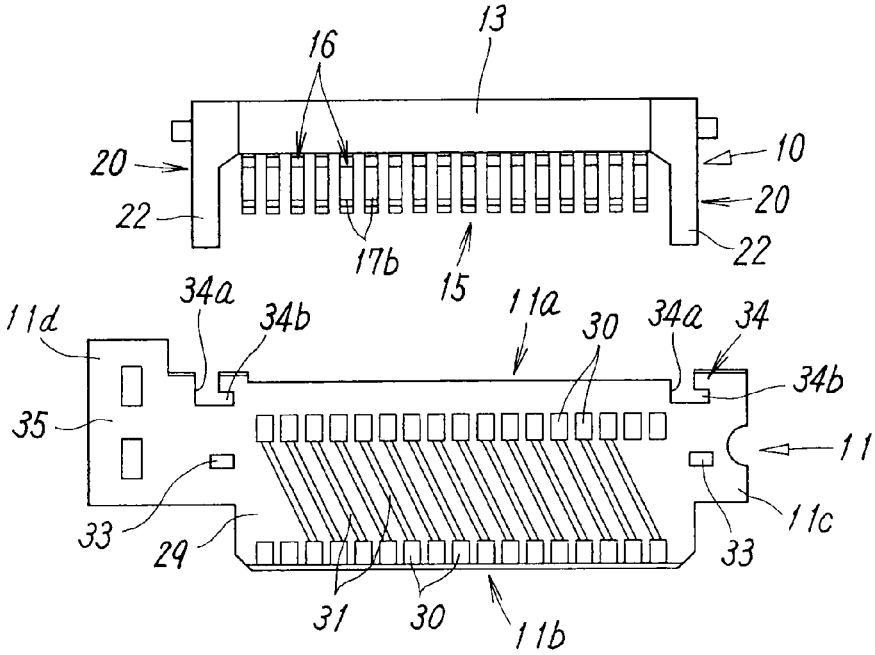
FIG. 2 is a plan view of FIG. 1.
Figure 4:
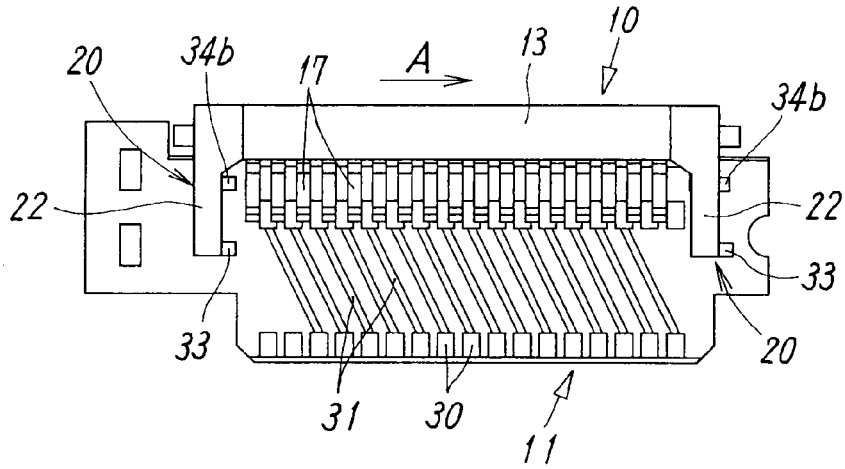
FIG. 4 is a plan view showing a halfway condition in which the connector main body and the plug substrate are being linked.
Figure 5:
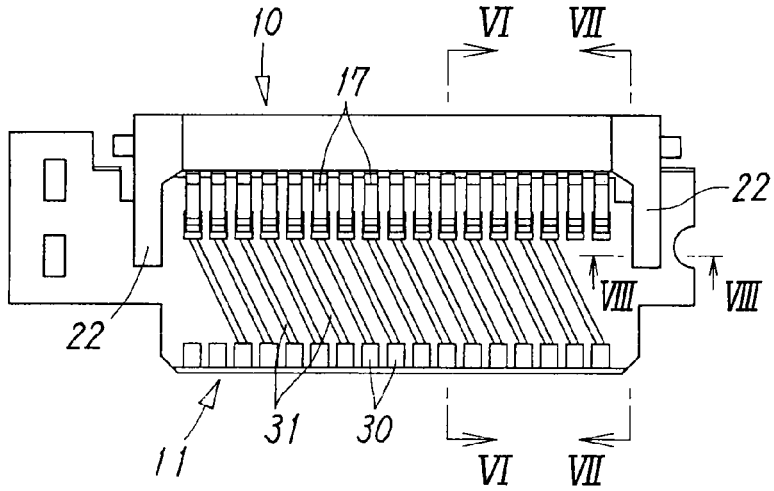
FIG. 5 is a plan view showing a condition after the connector main body and the plug substrate have been linked.
Figure 6:
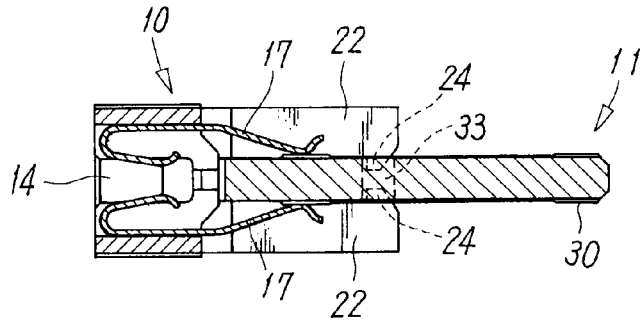
FIG. 6 is an enlarged cross-sectional view taken along the line VI-VI of FIG. 5.
Figure 7:
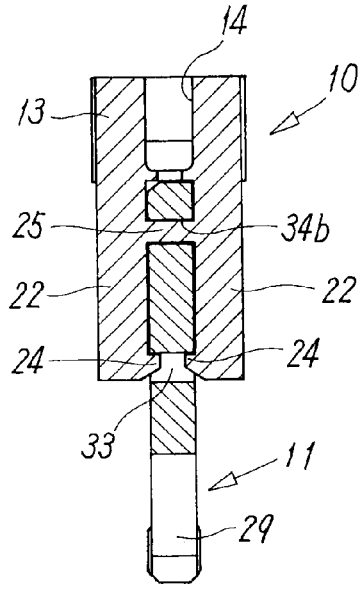
FIG. 7 is an enlarged cross-sectional view taken along the line VII-VII of FIG. 5.
Figure 8:
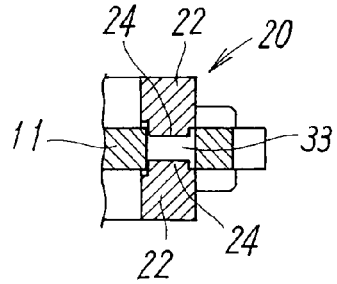
FIG. 8 is an enlarged cross-sectional view taken along the line VIII-VIII of FIG. 5.
Figure 9:
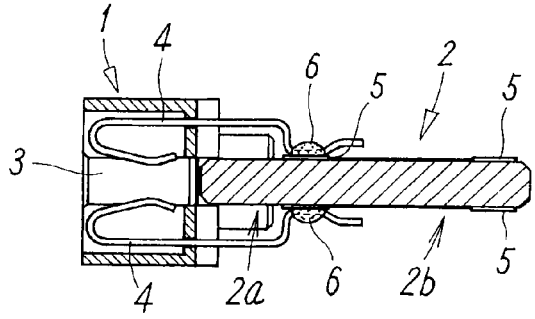
FIG. 9 is a cross-sectional view of a conventional stacking connector.

When attaching the plug substrate 11 to the connector main body 10, as shown in FIG. 2, from a state in which the substrate attaching member 15 of the connector main body 10 and the attachment side part 11*a* of the plug substrate 11 are facing each other, by pressing the connector main body 10 and the plug substrate 11 against each other, as shown in FIG. 4, the attachment side part 11*a* of the plug substrate 11 is inserted between the top-bottom pair of sandwiching arms 22 located at both left and right edges of the connector main body 10, and at the same time the attachment side part 11*a* of the plug substrate 11 is inserted between the rear end members 17*b* of the pair of elastic metal members 17 of the socket terminal 16. At this time, the pillar-shaped guide 25 of the connector main body 10 fits into the vertical hole part 34*a* of the notch 34 of the plug substrate 11, and the projections 24 at the front ends of the sandwiching arms 22 still ride on the plug substrate 11, so that a pair of the sandwiching arms 22 are elastically deformed to widen a gap between the sandwiching arms, and the projections 24 have not yet fitted into the concavities 33. In addition, each socket terminal 16 and plug terminal 30 are shifted laterally relative to each other and they are not correctly electrically connected.

Next, when sliding the connector main body 10 in a direction of arrow A shown in FIG. 4, or sliding the plug substrate 11 in the opposite direction of the arrow A, the pillar-shaped guide 25 is relatively moved to a location where it fits into the horizontal hole part 34*b* of the notch 34 as shown in FIGS. 5 to 8, so that the concavities 33 and projections 24 are also relatively moved to a location where they correctly face each other, and the projections 24 fit into the concavities 33 to engage with each other by resilience force of the sandwiching arms 22. As a result, the connector main body 10 and the plug substrate 11 are linked in an unremovable state. In addition, at the same time, each of the socket terminals 16 and plug terminals 30 are relatively moved to cancel their displacement, so that they are correctly contacted to each other to be electrically connected. These socket terminals 16 and plug terminals 30 are not soldered to each other.

Since, in this way, the connector main body 10 and the plug substrate 11 are linked to each other by an engagement of the projections 24 and the concavities 33, even when a force acting in a direction to separate them is applied, the acting force is received by an engagement force of the projections 24 and concavities 33, so that an unnecessary separation of the connector main body 10 and the plug substrate 11 is surely prevented. Furthermore, since the acting force is also received by an engagement force of the pillar-shaped guide 25 engaging into the horizontal hole part 34*b* of the notch 34, a connection strength between the connector 10 and the plug substrate 11 becomes extremely high. In addition, since there is no need to solder the socket terminals 16 and the plug terminals 30, an assembly operation of the stacking connector is easy.

The stacking connector is attached to a connective electromagnetic valve as described in the patent document 1 so that the connector main body 10 faces one side of the electromagnetic valve and the plug substrate 11 faces another side of the electromagnetic valve. When connecting a plurality of electromagnetic valves to form an electromagnetic valve assembly, the stacking connectors of adjacent electromagnetic valves are connected to each other by a plug-in mechanism, so that electric signals such as serial signals, parallel signals, and electric power signals are transmitted and received between the electromagnetic valves via the stacking connectors.

The invention claimed is:

1. A stacking connector comprising:

a connector main body including a substrate insertion slot which is open to a front, a substrate attaching member formed at a rear side, and a plurality of socket terminals extending from the substrate insertion slot to the substrate attaching member; and a plug substrate including a plurality of plug terminals, the plug substrate being attachable to and detachable from the substrate attaching member, the plug terminals electrically connected to the socket terminals by attaching the plug substrate to the substrate attaching member;

wherein the substrate attaching member of the connector main body comprises a substrate sandwiching member having a sandwiching gap into which the plug substrate fits, and a projection projecting from the substrate sandwiching member into the sandwiching gap, the plug substrate comprises an attachment side part fitting into the sandwiching gap of the substrate sandwiching member, an insertion side member extending from the connector main body to be inserted into a substrate insertion slot of another stacking connector, and a concavity opening in both top and bottom surfaces of the plug substrate, and after inserting the attachment side part into the sandwiching gap of the substrate sandwiching member, by sliding the plug substrate in a direction at right angles to the insertion direction, the concavity engages with the projection and the plug substrate is attached to the connector main body in an unremovable state.

2. The stacking connector according to claim 1, characterized in that the connector main body includes a pillar-shaped guide formed in the substrate sandwiching member, the plug substrate includes an L-shaped notch into which the pillar-shaped guide fits in the attachment side part, the notch comprises a vertical hole part that is elongated in a front-back direction of the plug substrate and a horizontal hole part that is elongated in a left-right direction of the plug substrate, and the pillar-shaped guide is constituted so that, after inserting the attachment side part of the plug substrate into the sandwiching gap in a state in which the pillar-shaped guide is fitted into the vertical hole part, when sliding the plug substrate in a direction at right angles to the insertion direction to engage the projections with the concavities, the pillar-shaped guide fits into and engages with the horizontal hole part of the notch.

3. The stacking connector according to claim 1, characterized in that the substrate sandwiching member comprising a top-bottom pair of sandwiching arms facing each other is formed at both left and right edges of the connector main body respectively, the projection is formed in each sandwiching arm, and the concavity is formed at both left and right sides of the plug substrate in locations corresponding to the sandwiching arms respectively.

4. The stacking connector according to claim 2, characterized in that the substrate sandwiching member comprising a top-bottom pair of sandwiching arms facing each other is formed at both left and right edges of the connector main body respectively, the projection and the pillar-shaped guide are formed in each sandwiching arm, and the concavity and the notch are formed at both left and right sides of the plug substrate in locations corresponding to the sandwiching arms respectively.

* * * * *